US005478062A

United States Patent [19]

Horiuchi et al.

[11] Patent Number: 5,478,062

[45] Date of Patent: Dec. 26, 1995

[54] SHEET POSTPROCESSING APPARATUS WITH SHEET HOLD-DOWN ARM

[75] Inventors: Toshihiro Horiuchi, Nara; Susumu Murakami, Ikoma; Kazuya Hamaguchi, Nara, all of Japan

[73] Assignee: Sharp Kabushiki Kaisha, Osaka, Japan

[21] Appl. No.: 266,343

[22] Filed: Jul. 1, 1994

[30] Foreign Application Priority Data

Aug. 25, 1993 [JP] Japan ..... 5-210743

[51] Int. Cl.[6] ..... B42B 5/00; B65H 43/00; B65H 31/26

[52] U.S. Cl. ..... 270/53; 355/324; 271/176; 271/220; 271/258.01

[58] Field of Search ..... 270/53; 355/324; 271/176, 220, 258.01, 258.02

[56] References Cited

U.S. PATENT DOCUMENTS

| | | | |
|---|---|---|---|
| 4,878,656 | 11/1989 | Honjo et al. | 270/53 |
| 4,988,085 | 1/1991 | Maekawa et al. | 270/53 |
| 5,021,837 | 6/1991 | Uto et al. | 270/53 X |
| 5,098,074 | 3/1992 | Mandel et al. | 270/53 |
| 5,112,034 | 5/1992 | Uto et al. | 270/53 |
| 5,137,265 | 8/1992 | Sato et al. . | |
| 5,288,062 | 2/1994 | Rizzolo et al. | 270/53 |
| 5,344,130 | 9/1994 | Suzuki et al. | 270/53 |
| 5,398,918 | 3/1995 | Rizzolo et al. | 270/53 |

FOREIGN PATENT DOCUMENTS

| | | | |
|---|---|---|---|
| 0346851 | 12/1989 | European Pat. Off. . | |
| 0371403 | 6/1990 | European Pat. Off. . | |
| 6-55874 | 3/1994 | Japan | 270/53 |

*Primary Examiner*—John E. Ryznic

[57] ABSTRACT

A sheet postprocessing apparatus installed in a copy machine includes a sheet pressing arm for pressing sheets on a sheet receiver from above towards the sheet receiver. When a stapling operation is carried out on the sheets stored on the sheet receiver, the sheets are fixed by the sheet pressing arm. The stable further process after copying can be carried out, thereby making the quality of the bundle of sheets which has undergone the stapling operation stabilize.

9 Claims, 11 Drawing Sheets

FIG. 11 (a) PRIOR ART
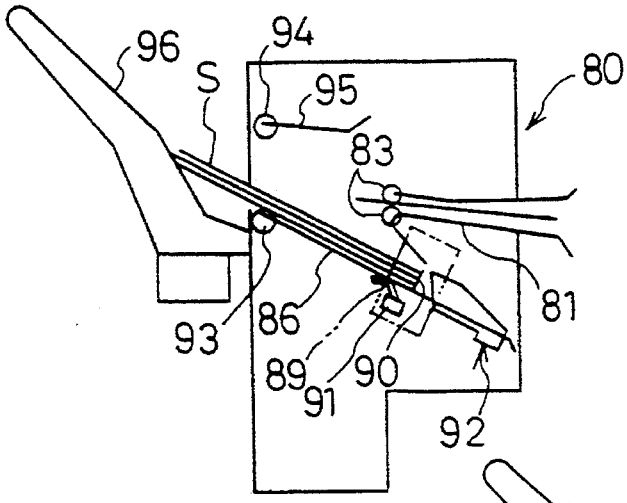
PRIOR ART
FIG. 11 (b)
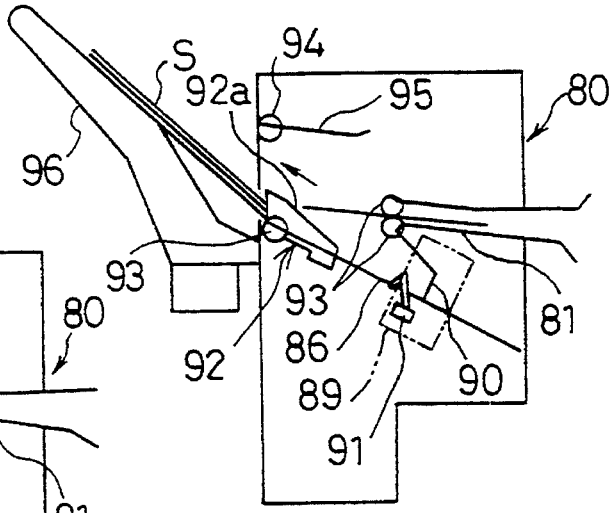
PRIOR ART
FIG. 11 (c)
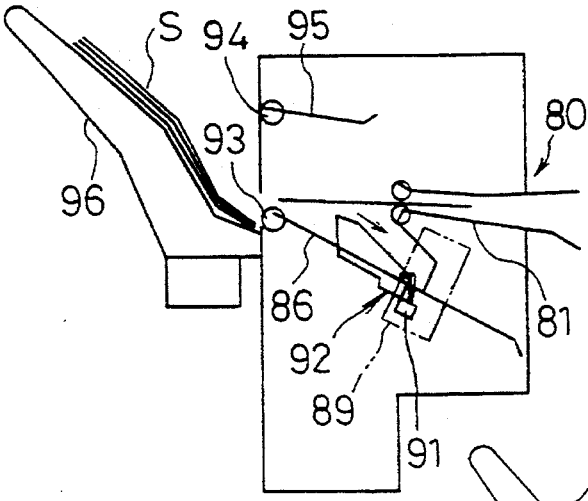
FIG. 11 (d) PRIOR ART
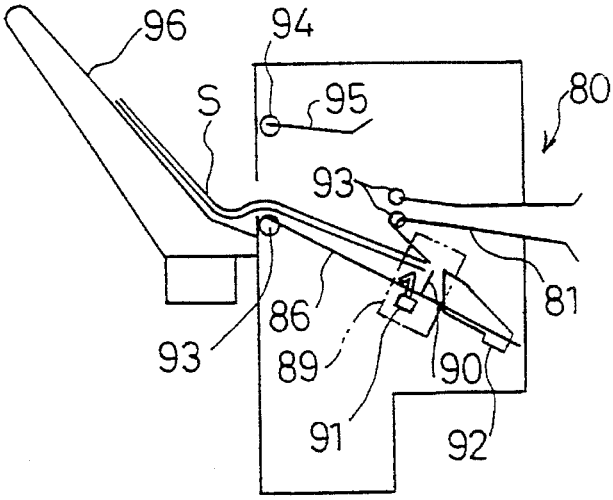

SHEET POSTPROCESSING APPARATUS WITH SHEET HOLD-DOWN ARM

FIELD OF THE INVENTION

The present invention relates to a sheet postprocessing apparatus, provided in image forming apparatuses such as copying machines, laser printers, etc., such process being the binding and/or punching sheets which have been fed from these apparatuses.

BACKGROUND OF THE INVENTION

Recently, a copying machine as an image forming apparatus is used together with a document circulator and a sheet postprocessing apparatus in order to automate a copying operation and sheet postprocessing such as binding or punching the copied sheets. The document circulator, which is provided on a document stand of the copying machine, for example, carries a plurality of documents onto the document stand one by one. Meanwhile, the sheet postprocessing apparatus binds or punches the sheets, which are discharged from the copying machine after the document image is copied, for each bundle of sheets which is consisted of a predetermined number of sheets.

As to this kind of conventional sheet postprocessing apparatus, for example, as disclosed in European Patent Publication No. 346,851, a device, which drives an endless transferring belt in one direction and discharges bound sheets onto a discharge tray from a sheet receiver by means of a pushing member provided on the transferring belt, is known. Furthermore, there has disclosed that the discharge tray is vertically movable and the height of the piled sheets is always kept substantially equal with that of the sheet receiver.

In addition, a device which has been disclosed in European Patent Publication No. 371,403 is known. In this device, a discharge tray is vertically and horizontally movable, and sheets are stored across a sheet receiver and the discharge tray. After one cycle of a copy operation is completed, a bundle of sheets are bound so that the bound bundle of sheets are discharged onto the discharge tray by using a discharge roller and an oscillating roller, or an ejector. Furthermore, there has disclosed that in a normal processing mode, the oscillating roller contacts with the discharge roller so that the sheets are discharged onto the discharge tray from the copy machine main body, whereas in a sheet postprocessing mode, the oscillating roller departs from the discharge roller so that the sheets are temporarily discharged on the sheet receiver from the copy machine main body, and thereafter, the oscillating roller contacts with the discharge roller so that the sheets are discharged onto the discharge tray.

In addition, as disclosed in U.S. Pat. No. 5,137,265, in the sheet postprocessing mode, recesses are provided on the discharge tray for staples to bind the sheets. Moreover, in the sheet postprocessing mode, if a size of sheets to be transported is larger than a predetermined size, the sheets across a sheet receiver and the discharge tray are discharged onto the discharge tray by the discharge roller and an oscillating roller. On the contrary, if the size of sheets to be transported is smaller than the predetermined size, the sheets remain across the sheet receiver and the discharge tray so as not to be discharged onto the discharge tray. Further, in the sheet postprocessing mode, an auxiliary tray is moved, and the discharge tray is placed on an extended line of the sheet receiver so that the sheets which have undergone the sheet postprocessing are discharged from the sheet receiver onto the discharge tray.

In the conventional sheet postprocessing apparatus which has been described above, as shown in FIG. 11(*a*), copied sheets S, which have been transported from a copy machine main body through a sheet postprocessing transport path 81, are dropped on a sheet receiver 86 by a transport roller 83 so as to be stored. Here, in the case where the sheets S are discharged without undergoing the sheet postprocessing, a driven roller 94 is descended towards a discharge roller 93 by an offset guide 95 so that the sheets S from the sheet postprocessing transport path 81 are caught between a discharge roller 93 and the driven roller 94, and discharged onto the discharge tray 96.

A judgement is made by a sheet detection sensor 91 provided on the sheet receiver 86 as to whether or not the sheets S exist on the sheet receiver 86. If a judgement is made by the sheet detection sensor 91 that the sheets S exist on the sheet receiver 86, a stapler device 89 built in a sheet postprocessing apparatus 80 binds the sheets S to make a book. The sheet detection sensor 91 is installed in the vicinity of the backward end stopper 90 which positions the backward end of the sheets on the sheet receiver 86 so as to be capable of detecting sheets having any size.

As shown in FIG. 11(*b*), a pusher 92 which contacts with the backward end of the sheet transporting direction advances along the sheet receiver 86 so that the bound sheets S are discharged onto the discharge tray 96. Furthermore, at this time, the discharge roller 93 provided on the forward end of the sheet receiver 86 rotates so as to help the sheets S to be discharged. After the sheets are discharged, as shown in FIG. 11(*c*), the pusher 92 retreats to its original position and is in a waiting state until the sheets are transported by the next copying operation.

However, the conventional sheet postprocessing apparatus 80 has a problem that a normal and stable sheet postprocessing cannot be carried out.

In other words, for example, in the case where the sheets S having a longer length than the sheet receiver 86 are stored, as shown in FIG. 11(*d*), since the forward end of the sheets S which is projected from the sheet receiver 86 descends because of its weight, bending is liable to occur on the sheets. As a result, a clearance might be caused between the sheet detection sensor 91 and the sheets S due to the bending of the sheets. If such a clearance is caused, the sheet detection sensor 91 cannot detect the existence of the sheets S. Therefore, even though the sheets S actually exist, there arises a trouble that the sheet postprocessing apparatus such as a stapler device does not operate due to a detection error by the sheet detection sensor 91.

In addition, since storing displacement of the sheets S on the sheet receiver 86 is liable to be caused due to such bending, even though the sheet detection sensor 91 normally operates, there also arises a problem that the sheet postprocessing is carried out with the sheet arrangement incomplete. Further, displacement is liable to occur also during the sheet postprocessing.

Moreover, in the case where a trouble such as jam in the document circulator occurs in the copy machine main body, the normal copy operation cannot be carried out, and invalid sheets which are blank are transported to the sheet postprocessing apparatus 80. However, in the conventional sheet postprocessing apparatus, since such invalid sheets are also stored on the sheet receiver 86 in the like manner of valid sheets where an normal image has been formed, the invalid sheets cannot be separated from the valid sheets, thereby causing troubles that the order of the sheets which have undergone the sheet postprocessing is inaccurate, the invalid sheets are mixed up with the valid sheets. etc.

SUMMARY OF THE INVENTION

It is an object of the present invention to provide a sheet postprocessing apparatus capable of preventing abnormality in an sheet postprocessing, displacement during storage and further process after copying, etc. from being caused due to bending of sheets. etc.

It is another object of the present invention to provide a sheet postprocessing apparatus where the order of sheets which have undergone the sheet postprocessing, etc is accurate, and invalid sheets which are blank are not mixed up with valid sheets.

In order to accomplish the above objects, the sheet postprocessing apparatus of the present invention provided with a sheet receiver for receiving sheets fed from an image forming apparatus and sheet postprocessing means for carrying out a predetermined sheet postprocessing on the sheets stored on the sheet receiver, is characterized by including:

pressing means for pressing the sheets stored on the sheet receiver from above towards the sheet receiver; and control means for controlling the pressing means so that the sheets are pressed when the predetermined sheet postprocessing is carried out on the sheets by the sheet postprocessing means.

With the above arrangement, when the sheets on the sheet receiver undergoes the predetermined sheet postprocessing by using the sheet postprocessing, since the sheets are pressed towards the sheet receiver by the pressing means which is controlled by the control means, the stable sheet postprocessing can be carried out with the position of the sheets being fixed. This makes a quality of the bundle of sheets which have undergone the sheet postprocessing stabilize.

In addition, another sheet postprocessing apparatus of the present invention provided with a sheet receiver for receiving sheets fed from an image forming apparatus, detection means for detecting whether or not the sheets exist on the sheet receiver, and sheet postprocessing after copying means for carrying out a predetermined sheet postprocessing on the sheets stored on the sheet receiver in accordance with the detected result of "sheets exist" by the detection means, is characterized by including:

pressing means for pressing the sheets on the sheet receiver towards the detection means; and control means for controlling the pressing means so that the pressing operation is carried out when the detection means detects that the sheets do not exist on the sheets receiver, and for making the detection means detect again as to whether or not the sheets exist on the sheet receiver after the pressing operation has been carried out.

With the above arrangement, in the case where the detection means detects the sheets do not exist, the pressing means is controlled so as to execute pressing operation. Therefore, for example, in the case where sheets having a longer length than the sheet receiver are fed from the image forming apparatus and bending, etc. occurs on the sheets, even if the detection means cannot detect the existence of the sheets, the pressing means presses the sheets where the bending, etc. occurs against the detection means so that the detection means again detects as to whether or not the sheets exist. As a result, detection error by the detection means is prevented, and the stable sheet postprocessing can be executed regardless of a size of sheets.

In addition, still another sheet postprocessing apparatus of the present invention according to the above second device, is characterized by that:

the detection means is installed so as to be capable of contacting with the sheets on the upper surface of the sheet receiver; and the control means controls so that the pressing operation is carried out a predetermined number of times when the detection result by the detection means is changed from "sheets non-exist" to "sheets exist" by the pressing operation of the pressing means.

With the above arrangement, as described above, bending is liable to occur on the sheets having a longer length, and irregularity of the sheets on the sheet receiver is liable to be caused to this bending. However, in the case where the detection result of the detection means is changed from "sheets non-exist" to "sheets exist" by the operation of the pressing means provided in the second sheet postprocessing apparatus, the pressing means is controlled so as to operate a predetermined number of times. In this way, the sheets where displacement occurred to the bending are arranged by operating the pressing means a predetermined number of times, thereby carrying out the sheet processing with higher stability and regularity.

In addition, still another sheet postprocessing apparatus of the present invention having a sheet receiver for receiving sheets transported from an image forming apparatus, the device being installed in the image forming apparatus capable of successively forming images, is characterized by including:

pressing means for pressing the sheets stored on the sheet receiver towards the sheet receiver; and control means for controlling the pressing means so that the pressing operation is carried out at the time all valid sheets are stored on the sheet receiver in the case where a trouble occurs in the image forming apparatus which successively carries out the image forming operation, and valid sheets where the image has been normally formed before the occurrence of the trouble and invalid sheets where the image has not been normally formed after the occurrence of the trouble are fed.

With the above arrangement, in the case where any trouble occurs in the image forming apparatus and invalid sheets where the normal image has not been formed are fed in the sheet postprocessing apparatus after the valid sheets where a normal image has been formed while the image forming apparatus successively executes the image forming operation, the control means controls the pressing means so that the valid sheets are pressed from above at the time all the valid sheets are stored on the sheet receiver.

Therefore, the invalid sheets which are fed after the valid sheets are stored on the pressing means, thereby clearly distinguishing the valid sheets from the invalid sheets. As a result, for example, when removing unnecessary invalid sheets by the time the image forming apparatus where a trouble has been released again executes the image forming operation, an operator does not have to check the sheets one by one and can easily remove only the invalid sheets, thereby executing the accurate sheet postprocessing without the possibility of the invalid sheets being mixed up with the valid sheets.

In addition, still another sheet postprocessing apparatus of the present invention according to the above fourth device is characterized by that the control means controls the pressing means so that the pressing operation is released when transportation of the invalid sheets to the sheet receiver is completed.

With the above arrangement, in the like manner of the fourth sheet postprocessing apparatus, the pressing means executes the pressing operation at the time all the valid sheets are stored on the sheet receiver, and when the invalid sheets to be stored on the pressing means are finished to be transported to the sheet receiver, the pressing operation of the pressing means is released. Since the pressing operation of the pressing means is carried out so as to press the valid sheets from above towards the sheet receiver, when this operation is released, the pressing means departs from the valid sheets to rise. When the pressing means rises, the invalid sheets stored thereon are raised. As a result, the valid sheets which stay on the sheet receiver are more distinguishable from the invalid sheets, thereby making it easier to remove the invalid sheets.

In addition, still another sheet postprocessing apparatus of the present invention according to the fourth device is characterized by that the control means controls the pressing means so that the pressing operation is released when a trouble release signal is received from the image forming apparatus.

With the above arrangement, when receiving the trouble release signal from the image forming apparatus, the pressing means releases the pressing operation and rises. Since the image forming apparatus restarts the image forming operation after the trouble is released, the pressing means departs from the valid sheets at the time of receiving the trouble release signal, thereby storing the sheets, which are fed by restarting the image forming operation, are stored one by one on the valid sheets.

In addition, still another sheet postprocessing apparatus of the present invention according to the fourth device, is characterized by that the control means controls the pressing means so that the pressing operation is released at a predetermined timing after the invalid sheets are removed and the image forming operation restarts.

With the above arrangement, after the invalid sheets are removed and the image forming operation restarts, the pressing means releases the pressing operation at a predetermined timing so as to rise. If the pressing means rises with the invalid sheets stored on the pressing means, the invalid sheets might dropped to be stored on the valid sheets by mistake due to a shock and vibration, etc. at the time the pressing means rises. Therefore, the fall-prevention means should be installed for the invalid sheets, but this becomes unnecessary by raising the pressing means at a predetermined timing after removing the invalid sheets and restarting the image forming operation.

In addition, still another sheet postprocessing apparatus according to the fourth device, is characterized by including:

invalid sheet detection means for detecting whether or not the invalid sheets stored on the pressing means exist, wherein the control means allows the pressing means to release the pressing operation when the invalid sheet detection means detects that the invalid sheets from the pressing means are removed.

With the above arrangement, the invalid sheet detection means is installed in the sheet postprocessing apparatus, and the pressing operation of the pressing means is allowed to be released when the invalid sheet detection means detects that the invalid sheets are removed. Therefore, since the pressing means does not rise with the invalid sheets stored on the pressing means, the invalid sheets do not fall down on the valid sheets.

BRIEF DESCRIPTION OF THE DRAWINGS

FIG. 6(*a*) shows a state where sheets are stored on a sheet receiver; FIG. 6(*b*) shows a state where sheets on the sheet receiver are pressed from above by the sheet pressing arm; FIG. 6(*c*) shows a state where sheets are discharged from the sheet receiver to a discharge tray; and FIG. 6(*d*) shows a state after sheets have been discharged.

FIG. 8 is a perspective view which shows an arrangement of a sheet receiver installed in a sheet postprocessing apparatus and its vicinity; and FIG. 9 is a flow chart which shows the procedure of processes in the sheet postprocessing apparatus when a trouble occurs in the image forming apparatus.

FIGS. 11(*a*) through 11(*d*) are explanatory drawings which show an operating state in the conventional sheet postprocessing apparatus: FIG. 11(*a*) shows a state where sheets are stored on a sheet receiver; FIG. 11(*b*) shows a state where the sheets have been discharged from the sheet receiver to a discharge tray; FIG. 11(*c*) shows a preparing state of the next copy operation; and FIG. 11(*d*) shows a state where sheets having a longer length than the sheet receiver are stored.

DESCRIPTION OF THE EMBODIMENTS

[EMBODIMENT 1]

Figure 3:
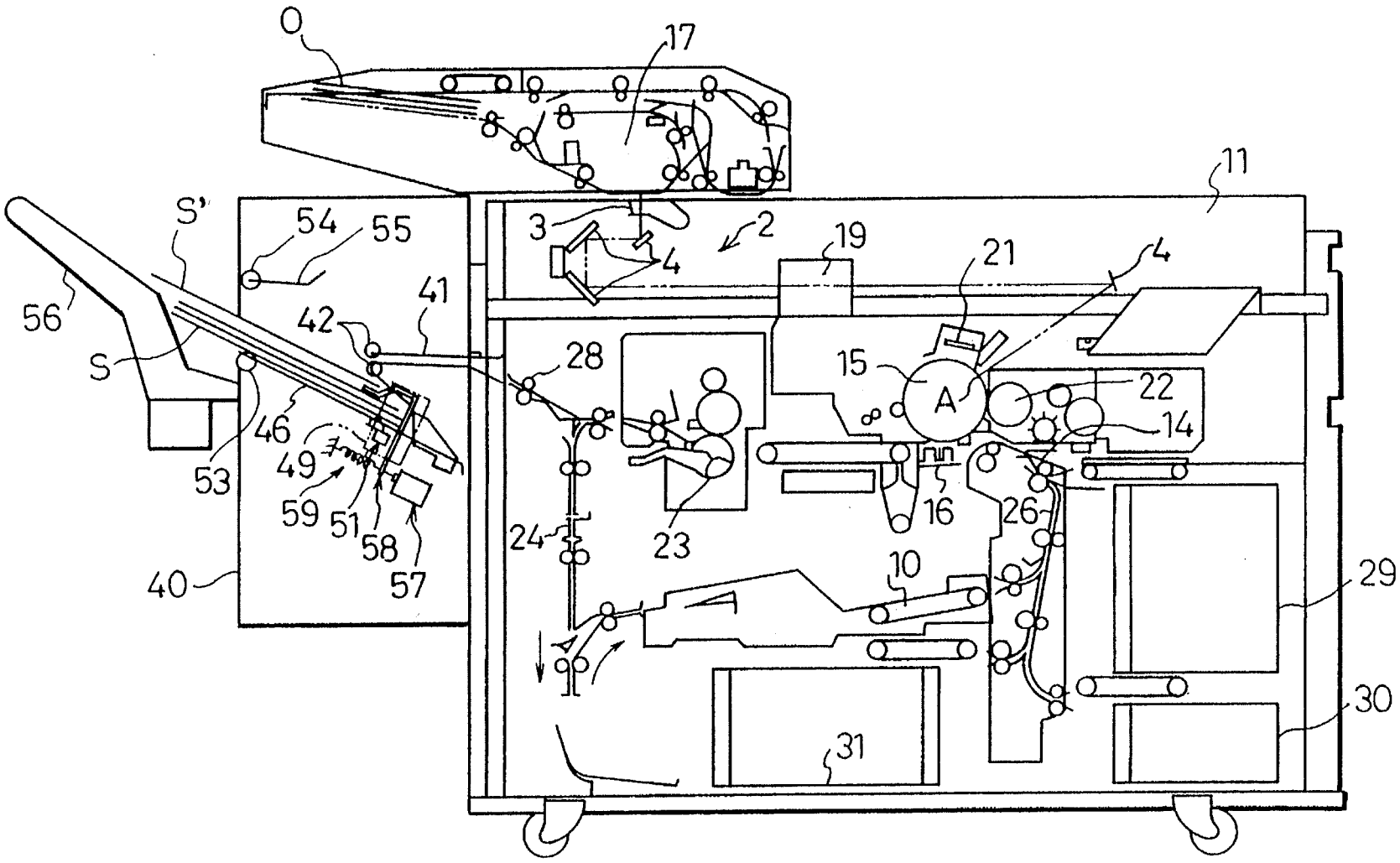
FIG. 3 is an explanatory drawing which shows an arrangement of a copy machine provided with the sheet postprocessing apparatus.

A sheet postprocessing apparatus of the present embodiment is provided, for example, in a copy machine as an image forming apparatus. The copy machine is arranged so as to include three components: a copy machine main body 11; a document circulator 17; and a sheet postprocessing apparatus 40 as shown in FIG. 3.

An optical system 2 including a copy lamp 3 such as a halogen lamp, a plurality of mirrors 4 . . . , zoom lens 19, etc. is arranged on the upper part of the copy machine main body 11. Further, the document circulator 17, which is provided on the upper face of the copy machine main body 11, circulates a plurality of documents O so that the documents O successively get a light of the copy lamp 3 through a slit, not shown.

The optical system 2 executes optical scanning by means of the light emitted from the copy lamp 3 on the documents O to be transported by the document circulator 17 and emits the obtained reflected light onto an exposed point A on a surface of an photoreceptor drum 15 through the mirrors 4 . . . and the zoom lens 19, thereby forming an electrostatic latent image corresponding to the image of the documents O on the surface of the photoreceptor drum 15 which has been uniformly discharged by a charger 21.

The charger 21, a developer device 22 and a transferring device 16 are arranged on the periphery of the photoreceptor drum 15 in this order. The electrostatic latent image formed on the surface of the photoreceptor drum 15 is visualized as a toner image by toner in the developer device 22. A sheet transport path 26 for transporting sheets S to the photoreceptor drum 15 is provided below the photoreceptor drum 15, and sheet trays 29, 30 and 31 for storing the sheet S are provided in the proximity of the sheet transport path 26. When the sheet S transported from one of the sheet trays 29, 30 and 31 through the sheet transport path 26 and a register roller 14 pass between the transferring device 16 and the photoreceptor drum 15, the toner image on the surface of the photoreceptor drum 15 is transferred on the sheets S. Thereafter, the sheet S is separated from the photoreceptor drum 15.

In addition, a fixing device 23, a discharge roller 28 and a transport path 24 are provided in the copy machine main body 11. The fixing device 23 fuses the toner image onto the sheet S by pressurizing and heating the sheet S where the toner image has been transferred, the sheet discharging roller 28 transports the sheet S whereon the toner image has been fused to the sheet postprocessing apparatus 40, and the retransport path 24 transports the sheet S again to the photoreceptor drum 15 so that copying on both sides of the sheet S, etc. is executed. The sheets S to be transferred from the retransport path 24 are transported into the sheet transport path 26 through a transport belt 10.

Figure 2:
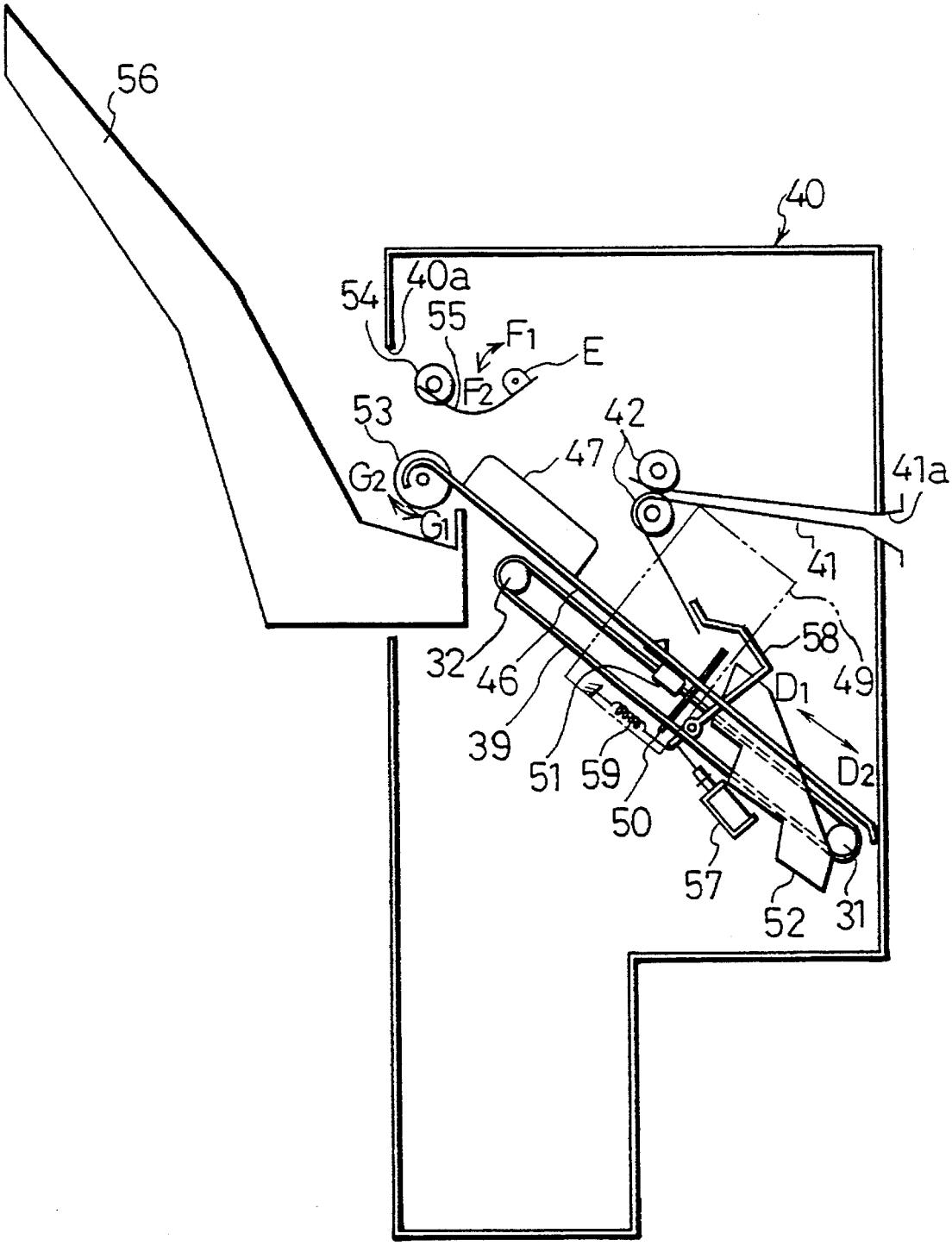
FIG. 2 is a sectional drawing of the sheet postprocessing apparatus.

As shown in FIG. 2, a sheet postprocessing transport path 41 for transporting the sheets S to be transported from the copy machine main body 11 into the device 40 is provided in the sheet postprocessing apparatus 40. A transport roller 42 is provided on a forward end of a sheet transporting direction in the sheet postprocessing transport path 41, and its backward end is provided as an entrance 41*a*.

A sheet receiver 46 for temporarily storing the sheets S to be subject to a staple process as a process after copying out of the sheets S which pass the sheet postprocessing transport path 41 is provided below the sheet postprocessing transport path 41. The sheet receiver 46 is slantingly arranged so that the forward end of the transporting direction of the stored sheets S is in the upper position with respect to its backward end. The forward end of the sheet receiver 46 reaches in the vicinity of a discharge opening 40*a* for the sheets S provided in the sheet postprocessing apparatus 40. A discharge tray 56 is provided on the discharge opening 40*a* of the sheet postprocessing apparatus 40.

Figure 1:
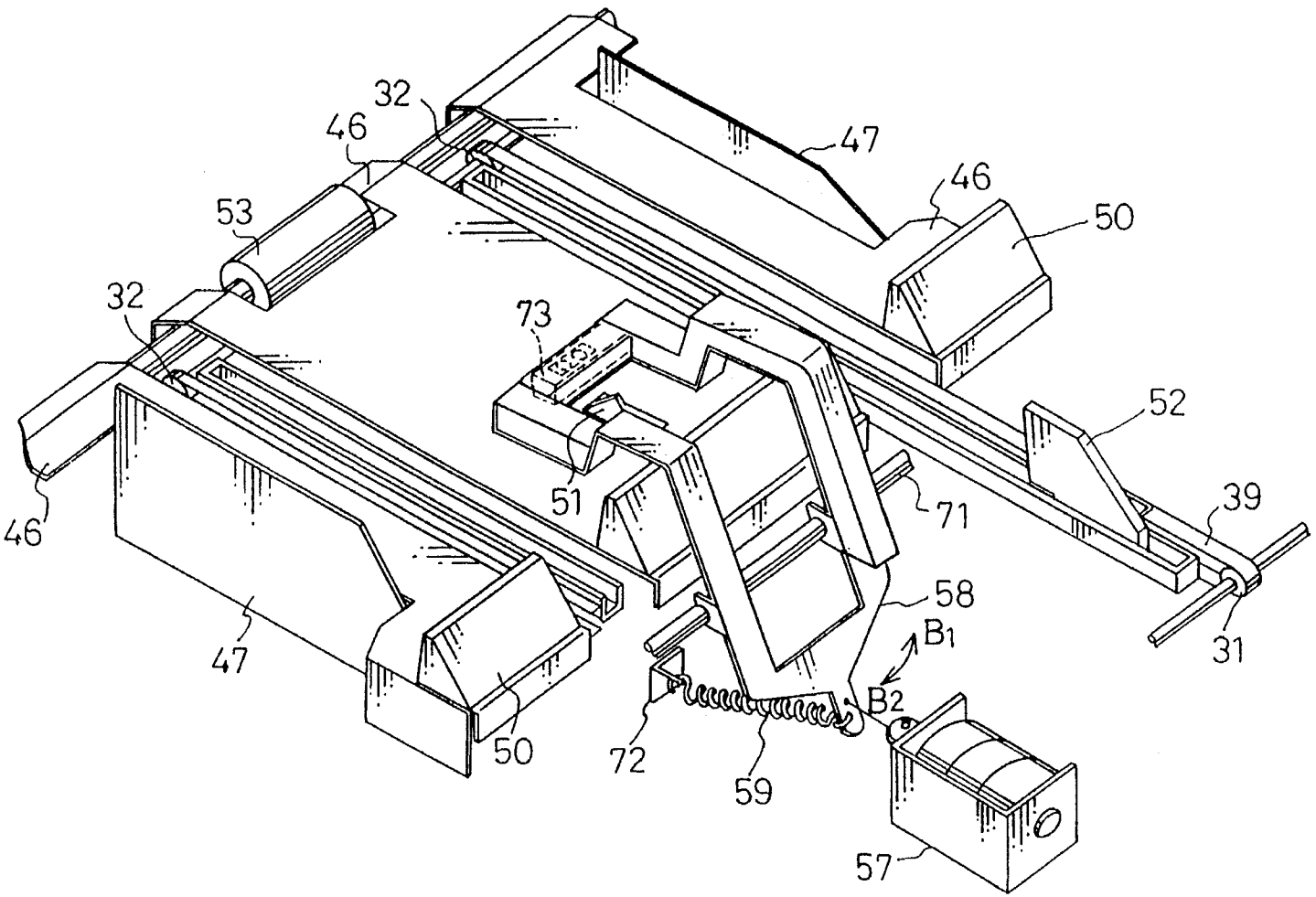
FIG. 1 is a perspective view which shows an arrangement of a sheet receiver installed in a sheet postprocessing apparatus according to one embodiment of the present invention, and its vicinity.

As shown in FIGS. 1 and 2, a backward end stopper 50 is provided on the backward end of the sheet receiver 46. The backward end stopper 50 stops the sheets S, which have been stored on the sheet receiver 46 through the sheet postprocessing transport path 41 by the transport roller 42, from slipping down along the inclination of the sheet receiver 46, and arranges regularly the backward end of the bundle of sheets which are composed of a plurality of the sheets S. Furthermore, a side jogger 47 for arranging regularly the side of the bundle of sheets on the sheet receiver 46 whose backward end has been arranged is provided on the both sides of the sheet receiver 46. A sheet detection sensor (detection means) 51 for detecting whether or not sheets are on the sheet receiver 46 in the proximity of the backward end stopper 50 with a contact with the sheets S being projected from the surface of the sheet receiver 46. In addition, a stapler device (sheet postprocessing means) 49 are provided in the sheet receiver 46. The stapler device 49 staples an edge on the backward end of the bundle of sheets which have been arranged regularly by the side jogger 47 and the backward end stopper 50 by using a staple so as to make a book. The stapling process by the stapler device is carried out by detecting whether or not the sheets S are on the sheet receiver 46 by means of the sheet detection sensor 51.

In addition, a pusher 52 for pushing the bundle of sheets stapled by the stapling process from the sheet receiver 46 towards the discharge opening 40*a* is provided so as to be movable forward and backward parallel with the side of the sheet receiver 46. The pusher 52 is connected to a pushing belt 39 which is wrapped around a belt driving roller 31 and a driven roller 32. When the belt driving roller 31 is rotated and the pushing belt 39 moves, the pusher 52 moves between an advance position in a direction $D_1$ where the bundle of sheets on the sheet receiver 46 are pushed onto a discharge tray 56 and a retreat position at the end of a direction $D_2$ on the sheet receiver 46.

Moreover, a sheet pressing arm (pressing means) 58 capable of freely rotating around a shaft 71 in a directions of $B_1$–$B_2$ is provided behind the sheet receiver 46. The sheet pressing arm 58 has a configuration that its forward end is bent towards the sheet receiver 46 passing over the backward end stopper 50. When the forward end is rotated downward, the sheets S on the sheet receiver 46 are pressed so as to contact with the sheet detection sensor 51. Further, a spring 59 and a solenoid 57 are installed at the backward end of the sheet pressing arm 58 which is placed below the shaft 71. The spring 59, one of whose end is installed on a fixing section 72 of the sheet postprocessing apparatus 40, energizes the sheet pressing arm 58 so that it rotates in the direction of $B_2$, and the solenoid 57 rotates the sheet pressing arm 58 in the direction of $B_1$ against the energizing force of the spring 59.

In other words, when the solenoid 57 is turned off, the sheet pressing arm 58 is rotated in the direction of $B_2$ by the energizing force of the spring 59, and the forward end of the sheet pressing arm 58 moves upward so as to depart from the sheet receiver 46. As a result, the sheets S on the sheet receiver 46 are released. Meanwhile, when the solenoid 57 is turned on, the sheet pressing arm 58 is rotated in the direction of $B_1$ against the energizing force of the spring 59, and the forward end of the sheet pressing arm 58 moves downward and the sheets S on the sheet receiver 46 are pressed. In this way, the pressing and departing operations of the sheet pressing arm 58 are controlled by the on/off operation of the solenoid 57.

In addition, an invalid sheet detection sensor (invalid sheet detection means) 73 for detecting whether or not the sheets S are on the sheet pressing arm 58 is provided at the forward end of the sheet pressing arm 58. While the sheet pressing arm 58 is pressing, the invalid sheet detection sensor 73 is used in the case, for example, where invalid sheets S', described later, (see FIG. 3) are transferred from the copy machine main body 11 so as to be stored on the sheet pressing arm 58 due to an occurrence of a trouble, etc. As shown in FIG. 2, a discharge roller 53 which rotates in the directions of $G_1$–$G_2$ is provided at the forward end of the sheet receiver 46. When being rotated in the direction of $G_2$, the discharge roller 53 moves the sheets S on the sheet receiver 46 towards the backward end stopper 50 so as to help the backward end stopper 50 to arrange the backward end of the sheets. Meanwhile, when being rotated in the direction of $G_1$, the discharge roller 53 helps the pusher 52 to discharge the bundle of sheets onto the discharge tray 56.

A driven roller 54 is provided above the discharge roller 53. The driven roller 54 is supported at one end of an offset guide 55 so as to freely rotate. The offset guide 55 is provided so as to be capable of rotating in the directions of $F_1$–$F_2$ around a fulcrum E provided at the other end. In the case where the sheets S fed from the copy machine main body 11 are discharged onto the discharge tray 56 without undergoing the stapling operation, when the offset guide 55 rotates in the direction of $F_2$ in accordance with the rotation of the discharge roller 53 in the direction of $G_1$, so the sheets S are caught between the driven roller 54 and the discharge roller 53 so as to be directly discharged onto the discharge tray 56 through the sheet postprocessing transport path 41.

Figure 4:
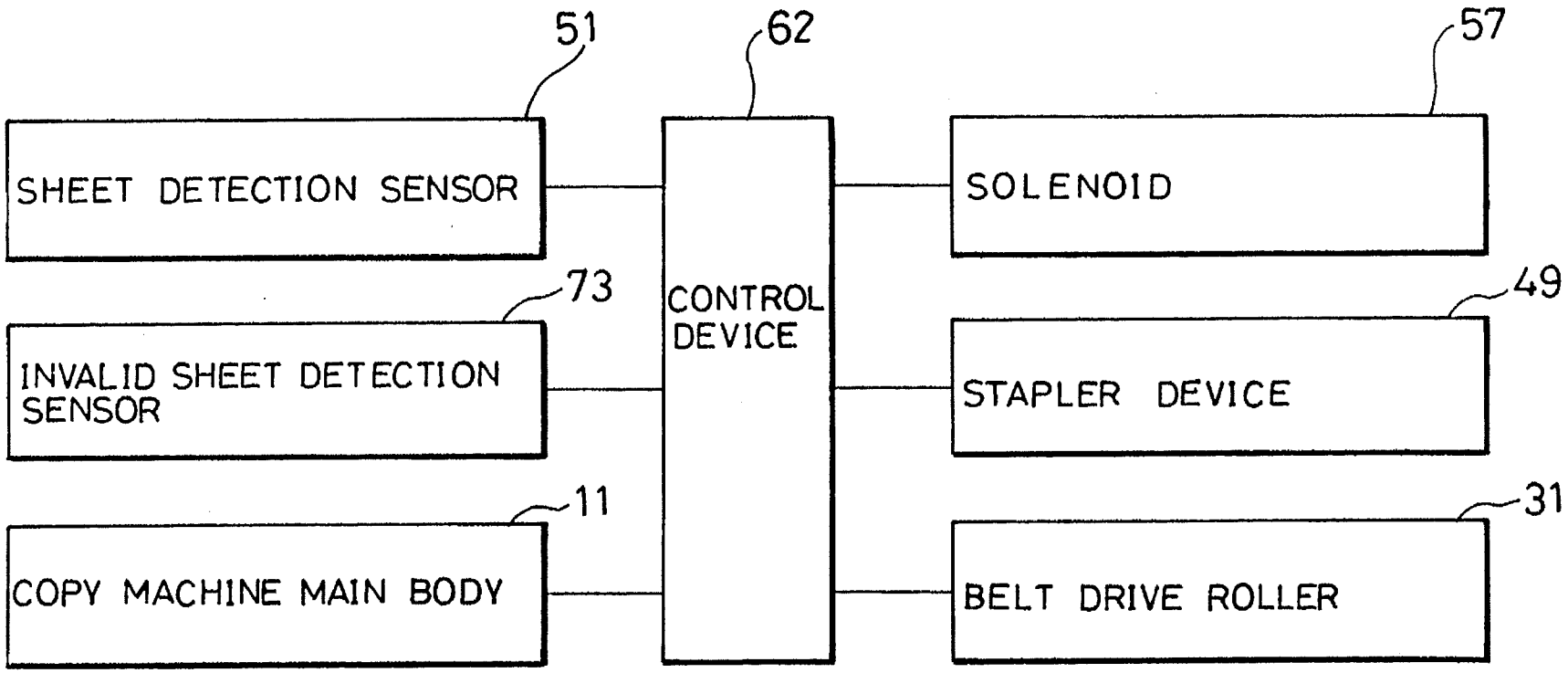
FIG. 4 is a block diagram which shows a constitution of a control section provided in the sheet postprocessing apparatus.

As shown in FIG. 4, the sheet postprocessing apparatus 40 includes a control device (control means) 62 for controlling operations of the solenoid 57, the stapler device 49, the belt driving roller 31, etc. based upon the input signals from the sheet detection sensor 51, the invalid sheet detection sensor 73 and the copy machine main body 11. The control device 62 is composed of a microcomputer including a storing device, a counter, etc.

Further, the control device 62 includes first and second timers for detecting timing of operating the sheet pressing arm 58 in the case, for example, where a normal copy operation is executed halfway due to an occurrence of a trouble such as a jam in the document circulator 17. If this kind of trouble occurs, the blank sheets S which have been fed in the copy machine main body 11 before the occurrence of the trouble, are transported to the sheet postprocessing apparatus 40 as the invalid sheets S' after the valid sheets S where a valid image has been formed by the normal copy operation.

The first timer detects a time to store the final valid sheet, which has been discharged from the copy machine main body 11 by the normal copy operation before the occurrence of the trouble, onto the sheet receiver 46 so as to detect timing when the solenoid 57 is turned on. The timing detection starts at the time a discharge detection sensor, not shown, provided in the copy machine main body 11 detects the discharge of the final valid sheet from the copy machine main body 11, and ends at the time a predetermined setting time comes. The setting time is a time to transport the sheets S to the sheet receiver 46 just after the sheets S pass through the discharge detection sensor, and is set according to a size of sheets to be used.

In addition, the second timer detects a time to store all the invalid sheets S' on the sheet receiver 46, so as to detect timing of a trouble treatment waiting state with the operation of the copy machine main body stopped. The detection starts at the time the solenoid 57 is turned on after the detection by the first timer is completed. The detection ends at the time a predetermined setting time comes. In this case, the setting time means the time to transport the invalid sheets S' onto the sheet receiver 46 just after the solenoid 57 is turned on, and is set according to a size of sheets to be used.

Figure 5:
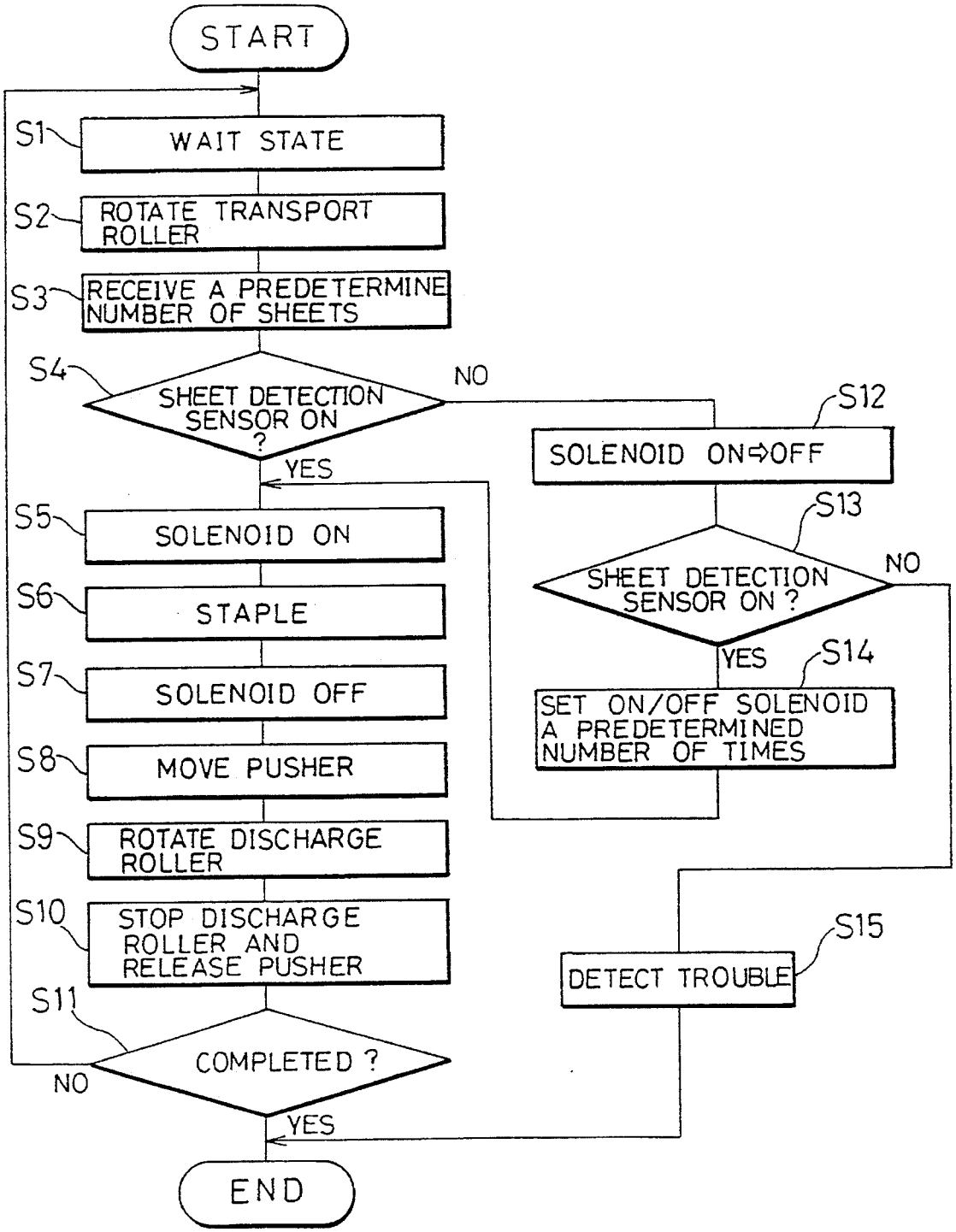
FIG. 5 is a flow chart which explains an operation of the sheet postprocessing apparatus.

The following description will discuss a procedure of the copy operation by using the sheet postprocessing apparatus in the copy machine having the above arrangements referring to a flow chart of FIG. 5.

First, when the power supply of the copy machine main body 11 (see FIG. 3) is turned on, a predetermined warm-up operation is carried out and the copy machine main body 11 is in a stand by state (S1). In the stand by state, a plurality of documents O are set in the document circulator 17, and when an operator presses down a copy button, not shown, the document circulator 17 starts an operation so as to start a predetermined copy operation. When the copy operation starts, the transport roller 42 (see FIG. 2) in the sheet postprocessing apparatus 40 starts to rotate (S2). Here, the transport roller 42 is always rotating during the copy operation. In this state, the solenoid 57 is turned off, and the sheet pressing arm 58 is in a state where it departs from the sheet receiver 46. The pusher 52 is in the retreat position behind the backward end stopper 50, and the sheet detection sensor 51 stands by in an OFF state.

The predetermined number of sheets S which have been preliminarily set according to a number of the set documents O are transported into the sheet postprocessing apparatus 40 through the sheet postprocessing transport path 41 (S3) by the above copy operation. When the sheets S are stored on the sheet receiver 46 (see FIG. 6(*a*)), the sheet detection sensor 51 detects the sheets S on the sheet receiver 46, and is in an ON state. When a judgement is made at S4 that the sheet detection sensor 51 is in the ON state, the solenoid 57 is turned on (S5). Then the sheet pressing arm 58 is set and presses the sheets S on the sheet receiver 46 (see FIG. 6(*b*)).

In this way, the stapler device 49 operates by an 0N signal outputted from the sheet detection sensor 51 and the setting of the sheet pressing arm 58 so as to execute a stapling process (S6). Then a bundle of sheets which are consisted of a plurality of sheets S stored on the sheet receiver 46 are bound. At this time, the sheet pressing arm 58 presses the sheets S, thereby preventing sheets S from being irregular when the stapling process is executed. After the stapling process, the solenoid 57 is turned off (S7), and the sheet pressing arm 58 is executed so as to release the bound bundle of sheets. Thereafter, when the pusher 52 advances along the sheet receiver 46 with it touching with the backward end of the bundle of sheets (S8), the discharge roller 53 provided at the forward end of the sheet receiver 46 rotates at the peripheral speed in accordance with a sheet pushing speed in synchronization with the advance of the pusher 52 (S9), and the bundle of sheets are discharged onto the discharge tray 56 (see FIG. 6(*c*)).

Figure 6:
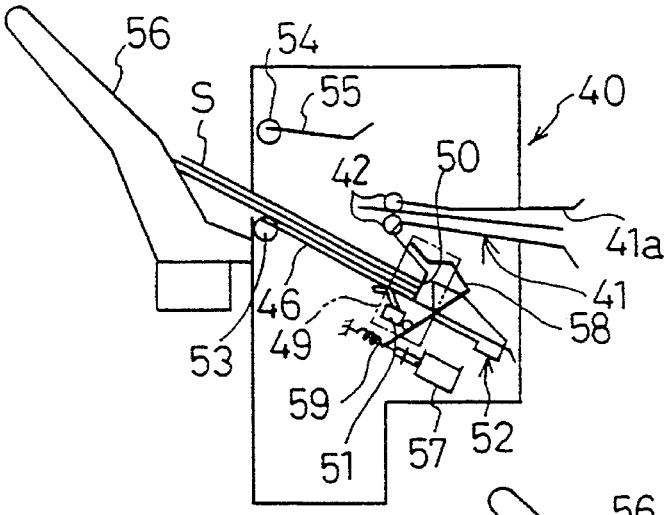
FIGS. 6(*a*) through 6(*d*) are explanatory drawings which show an operating state in*.
Figure 6:
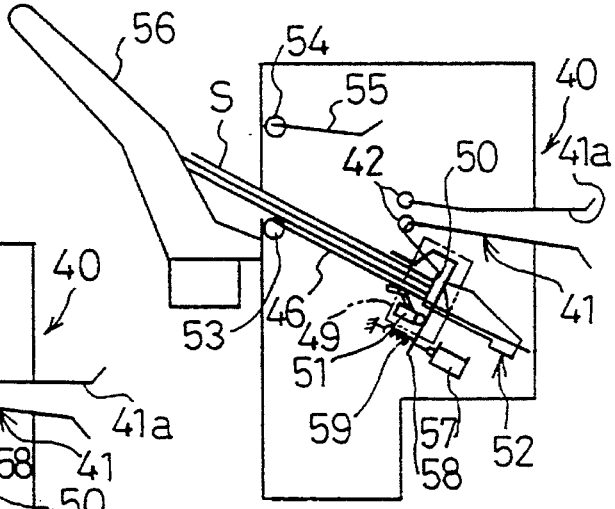
Figure 6:
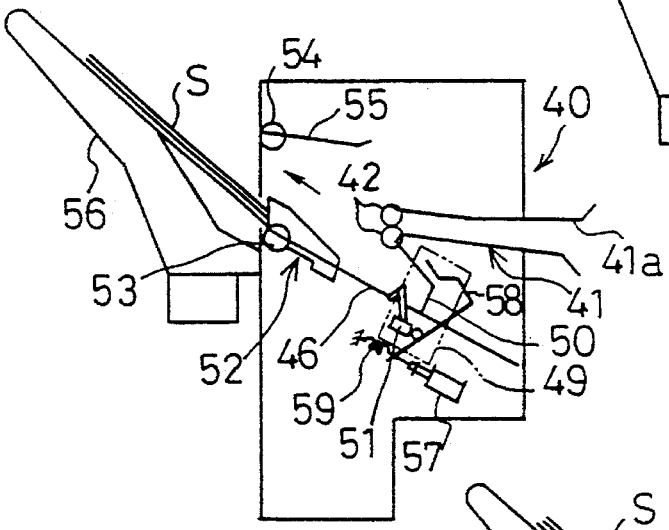
Figure 6:
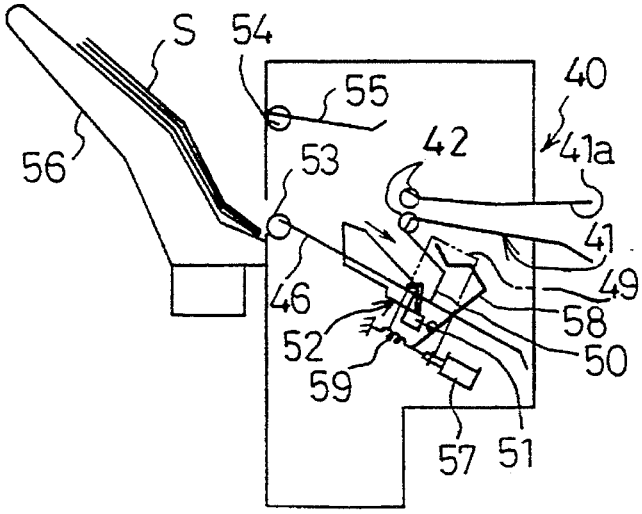

After the bundle of sheets are discharged onto the discharge tray 56, the discharge roller 53 stops and the pusher 52 retreats to the original retreat position (S10) (See FIG. 6(*d*)). In this state, if an input for indicating the completion of the operation is not discriminated (S11), the copy machine main body 11 enters the stand by state again (S1) until the next copy operation is specified. Further, if the input for indicating the completion of the operation is discriminated at S11, a predetermined completion operation is carried out.

Meanwhile, if a judgement is made at S4 that the ON signal representing the existence of the sheets S on the sheet receiver 46 is not outputted from the sheet detection sensor 51, the solenoid 57 is temporarily turned on and is turned off immediately (S12). Then the judgement is made again as to whether or not the ON signal is outputted from the sheet detection sensor 51 (S13).

Incidentally, for example, in the case where a length of the sheets S is longer than that of the sheet receiver 46, since the forward end of the sheets which is projected from the sheet receiver 46 hangs down from the sheet receiver 46 under the influence of its own weight, the sheets S are bent while describing an arc. As a result, the backward end of the sheets which should touch with the sheet detection sensor 51 is raised. For this reason, although the sheets S are actually stored on the sheet receiver 46, the sheet detection sensor 51 cannot execute the detection, thereby causing a situation that the stapler device 49 does not operate. Therefore, even if the sheet detection sensor 51 does not output the 0N signal, the solenoid 57 is once turned on so that the sheet pressing arm 58 operates. As a result, the sheet detection sensor 51 is pressed by the backward end of the sheets S which have been raised due to the above cause, and detects the existence of the sheets S on the sheet receiver 46.

When the judgement is made at S13 by the operation of the sheet pressing arm 58 that the ON signal is outputted from the sheet detection sensor 51, the solenoid is repeatedly turned on and off a predetermined number of times (S14). Then the sheet pressing arm 58 moves vertically a plurality of times so as to arrange the backward ends of the sheets S from above. Since a displacement, etc. is liable to occur on the sheets S which have been bent on the sheet receiver 46, this operation is carried out so as to eliminate the displacement. Thereafter, the operations after S5 are successively carried out.

In addition, in the case where the judgement is made at S13 that the ON signal is not outputted from the sheet detection sensor 51 although the sheet pressing arm 58 operates, it is detected that the sheets S are not stored on the sheet receiver 46, and that any trouble occurs on the copy machine main body 11 or the document circulator 17 (S15).

In a copy machine whose purpose is a high-speed copying, a system that sheets are successively fed at regular intervals so as to be transported is adopted. For this reason, if a trouble such as a jam occurs in the document circulator 17, the sheets S, where a document image unexposed due to the occurrence of trouble should be formed, have already been fed into the copy machine main body 11, and are being transported in the copy machine main body 11. In other words, in the case where, for example, five documents are set in the document circulator 17, if a trouble occurs before the exposing operation on the fourth document is finished, the image can be formed on the first three sheets of the fed sheets S in the copy machine main body 11 and these three sheets are discharged as the valid sheets S. However, the image cannot be formed on the fourth and the fifth sheets, and the two sheets are discharged as the invalid sheets S'.

Furthermore, the above kind of a copy machine is normally arranged so as to discharge the invalid sheets S' without staying the invalid sheets S' in the copy machine main body 11. Therefore, the both of the three valid sheets S where the valid image has been formed and the two invalid sheets S' which have been discharged in a blank state are transported into the sheet postprocessing apparatus 40, and are stored on the sheet receiver 46.

Figure 7:
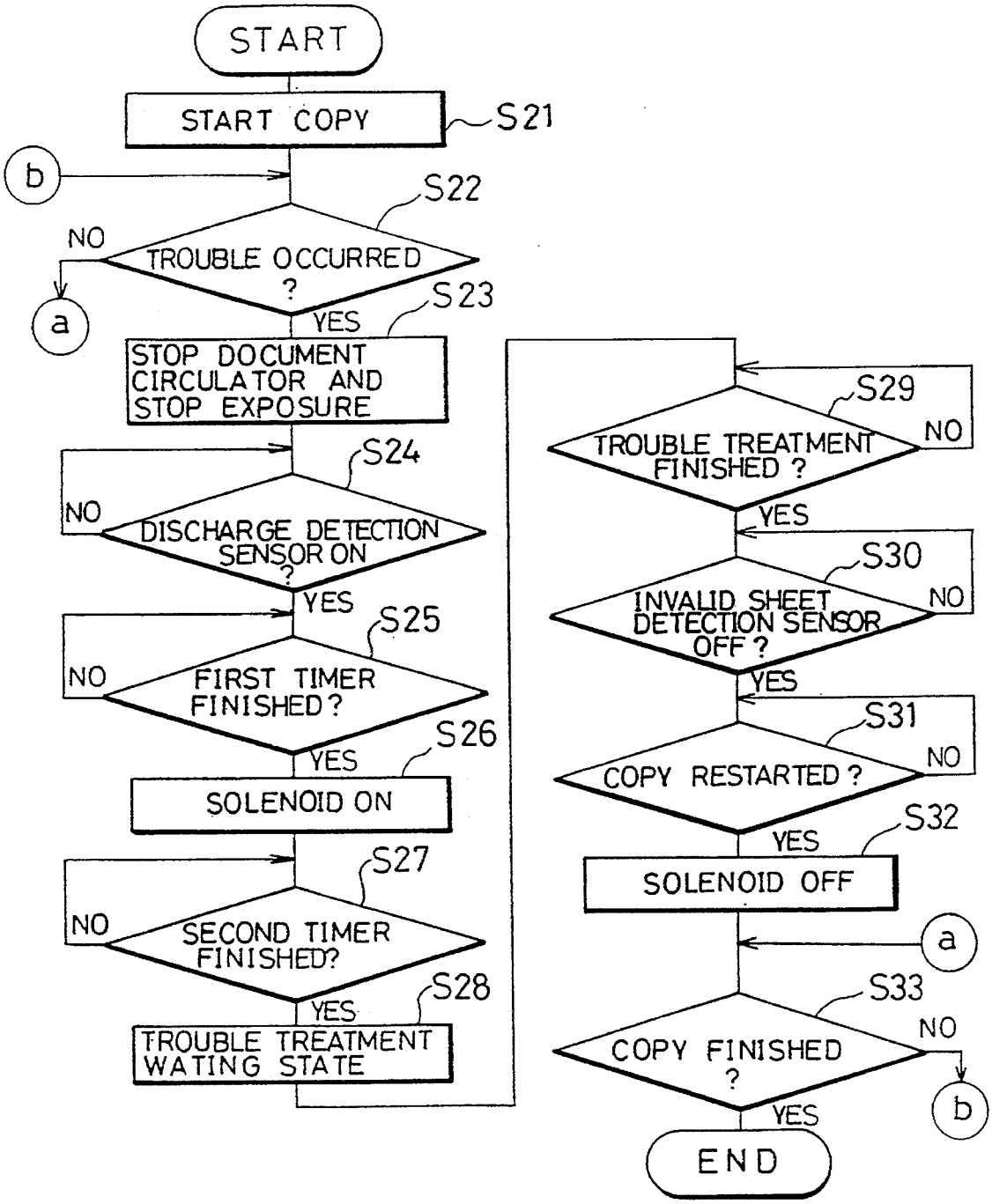
FIG. 7 is a flow chart which shows the procedure of processes in the sheet postprocessing apparatus when a a trouble occurs in an image forming apparatus.

Next, the following description will discuss control for operating the sheet pressing arm 58 in order to sort out the valid sheets S from the invalid sheets S' stored on the sheet receiver 46 referring to a flow chart of FIG. 7.

First, when the copy button is pressed down by an operator, the documents O set in the document circulator 17 are successively circulated, and the copy operation starts (S21). Thereafter, in the copy machine main body 11, the exposing operation is successively executed on the circulating documents O, and the sheets S according to a number of the documents are fed at predetermined intervals. Here, for example, if the set number of the documents is five and a jam occurs in the document circulator 17 during the exposure of the fourth document, since the first three documents are exposed, the first three sheets of the fed sheets S, exist in the proximity of the photoreceptor drum 15 as the valid sheets S where an image has been formed.

When the occurrence of the trouble is detected (S22), the document circulator 17 stops so as to limit its damage to a minimum, and the copy machine main body 11 suspends the exposing operation (S23) after receiving a trouble occurrence signal from the document circulator 17. Moreover, the copy machine main body 11 discharges the fourth and fifth invalid sheets S', on which an image cannot be formed, into the sheet postprocessing apparatus 40 together with the three valid sheets S with normal sheet transporting intervals being kept. Then the copy machine main body 11 converts the trouble signal received from the document circulator 17 so as to transmit it to the sheet postprocessing apparatus 40.

In the sheet postprocessing apparatus 40, a judgement is made as to whether or not the ON signal is outputted from the discharge detection sensor installed in the copy machine main body 11 (S24), and at the moment the 0N signal is outputted from the discharge detection sensor, in other words, the first valid sheet S is discharged from the copy machine main body 11, the first timer installed in the control device 62 in the sheet postprocessing apparatus 40 is started. In the sheet postprocessing apparatus 40, a number of the valid sheets S and the invalid sheets S' can be detected based upon the trouble signal from the copy machine main body 11, and setting time of the first timer is a necessary time from a point when the ON signal is outputted from the discharge detection sensor to a point when the third valid sheet S is transported to the sheet receiver 46.

When a judgement is made that the operation of the first timer is completed (S25), since the three valid sheets S are finished to be stored onto the sheet receiver 46, the solenoid 57 is turned on (S26), thereby setting the sheet pressing arm 58 on the three valid sheets S on the sheet receiver 46. In addition, at this time, the second timer installed in the control device 62 is started. The setting time of the second timer is a period from a point when the sheet pressing arm 58 is set to a point when the two invalid sheets S' are transported onto the sheet receiver 46. When a judgement is made that the operation of the second timer is completed (S27), since the two invalid sheet S' are finished to be stored onto the sheet pressing arm 58, the copy machine main body 11 is in the trouble treatment waiting state (S28). Here, in this state, the invalid sheets S' on the sheet pressing arm 58 has been detected by the invalid sheet detection sensor 73 installed on the sheet pressing arm 58.

Next, a judgement is made in the document circulator 17 as to whether or not a trouble treatment such as resetting of a document is carried out (S29). If the trouble treatment is completed, successively a judgement is made as to whether or not the invalid sheet detection sensor 73 is turned off (S30) so that a judgement is made as to whether or not the invalid sheets S' are removed from the sheet pressing arm 58.

Here, in the case where an operator takes out the invalid sheets S' on the sheet pressing arm 58 from the discharge opening 40*a*, the valid sheets S are pressed by the sheet pressing arm 58 so as not to be taken out, thereby easily taking out only the invalid sheets S with the invalid sheets S' separated from the valid sheets. Moreover, since the valid sheets S are fixed to a position which has been arranged by the side jogger 47 and the backward end stopper 50, a displacement of the valid sheets S does not occur by removing the invalid sheets S'.

When the invalid sheets S' are removed, a judgment is made as to the off state of the invalid sheet detection sensor 73. This judgement allows the sheet pressing arm 58 to depart from the sheet receiver 46 and releases the trouble treatment waiting state in the copy machine main body 11.

Thereafter, when the copy operation is started on the fourth document, a judgement is made that the copy operation is restarted (S31). After the copy operation restarts, the solenoid 57 is turned off (S32) at a predetermined timing until the sheets S are transported from the copy machine main body 11. As a result, the sheet pressing arm 58 departs from the sheet receiver 46, and the sheets S are transported after undergoing the normal copy operation, which is carried out before the occurrence of a trouble, so that the sheets S on which the image of the fourth and the fifth documents has been copied are successively stored on up to the third valid sheet S on the sheet receiver 46. Thereafter, if a judgement is made at S33 that the copy operation is carried out on a predetermined number of sheets, the copy operation ends.

Here, a timing that the solenoid 57 is turned off, in other words, a timing that the departing operation is executed on the sheet pressing arm 58 is set at a point when a predetermined time passes just after the copy operation restarts in the copy machine main body 11, and is determined in accordance with a copy start signal by the copy button operation, a signal representing that the sheets are transported to a predetermined position, a discharge signal from the discharge detection sensor, etc.

Meanwhile, when a judgement is made at S30 that the invalid sheet detection sensor 73 is not turned off, the invalid sheets S' remains on the sheet pressings arm 58. If an operator does not remove the invalid sheets S', the departing operation on the sheet pressing arm 58 is not allowed, and also the trouble treatment waiting state of the copy machine main body 11 is not released.

As mentioned above, since the sheet pressing arm 58 for pressing from above the sheets S stored on the sheet receiver 46 is installed in the sheet postprocessing apparatus 40 of the present embodiment, in the case where the stapling operation, etc. is carried out, the sheets S are fixed by the sheet pressing arm 58 so as to make it possible to carry out the stable sheet postprocessing, thereby making the quality of the bundle of sheets which has undergone the sheet postprocessing stable.

In addition, even if a gap is produced between the sheets and the sheet detection sensor 51 due to the occurrence of the bending, etc. of the sheets S stored on the sheet receiver 46, a detection error by the sheet detection sensor 51 can be prevented by pressing the sheets S by the sheet pressing arm 58 so that the sheets S touch with the sheet detection sensor 51. Further, even if the backwards end of the sheets S is not arranged due to the bending, the sheets S on the sheet receiver 46 are arranged regularly by vertically moving the sheet pressing arm 58 a plurality of times, thereby carrying out the stable sheet postprocessing.

In addition, if a trouble occurs in the document circulator 17, and the valid sheets S and the invalid sheets S' are transported to the sheet postprocessing apparatus 40, the sheet pressing arm 58 is controlled so as to be set at the moment all the valid sheets S are stored on the sheet receiver 46. Therefore, the valid sheets S can be clearly separated from the invalid sheets S', thereby making it possible to remove only the invalid sheets S'. Further, in the case where the invalid sheets S' are removed, since the valid sheets S are fixed to the sheet receiver 46 by the sheet pressing arm 58, the possibility that the storing position of the valid sheets S is displaced can be avoided.

The invalid sheet detection sensor 73 detects that the invalid sheets S' are removed from the sheet pressing arm 58 so that the departing operation of the sheet pressing arm 58 is allowed and carried out at a predetermined timing after the copy operation restarts. Incidentally, in the case where the departing operation of the sheet pressing arm 58 is carried out with the invalid sheets S' stored on the sheet pressing arm 58, there causes the possibility that the invalid sheets S' fall down from the sheet pressing arm 58 due to a vibration, etc. which occurs during the departing operation, and are stored on the valid sheets S transported to the sheet receiver 46 before the occurrence of the trouble. However, as mentioned above, the departing operation of the sheet pressing arm 58 is carried out only after the invalid sheets S' are removed, thereby avoiding the possibility that the invalid sheets S' fall down on the valid sheets S.

In the case where the sheets S are transported by restarting the copy operation, since the removal of the invalid sheets S' and the departing operation of the sheet pressing arm 58 are certainly executed, the invalid sheet S' do not mix with the sheets S stored on the sheet receiver 46. Further, since the sheets S are always stored in order, the accurate stapling operation can be carried out.

Here, in the present embodiment, the description discussed the sheet postprocessing giving an example in the case where the sheet postprocessing apparatus 40 performs the stapling operation. However, even in the case where a punching is carried out as the sheet postprocessing, the similar result can be produced by providing the sheet pressing arm 58 and by controlling its operation in the like manner of the above.

[EMBODIMENT 2]

Figure 8:
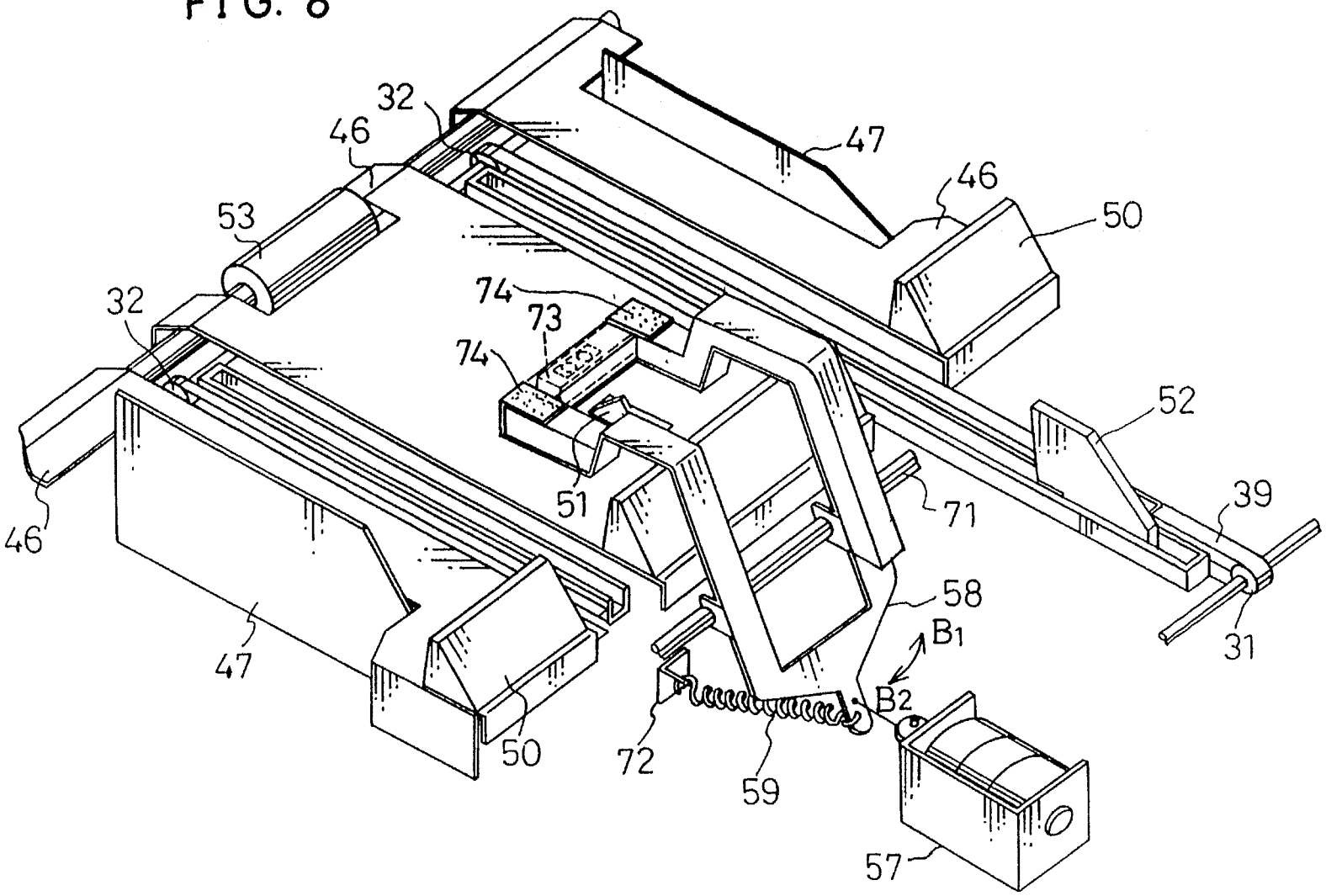
FIGS. 8 and 9 show another embodiment of the present invention.
Figure 9:
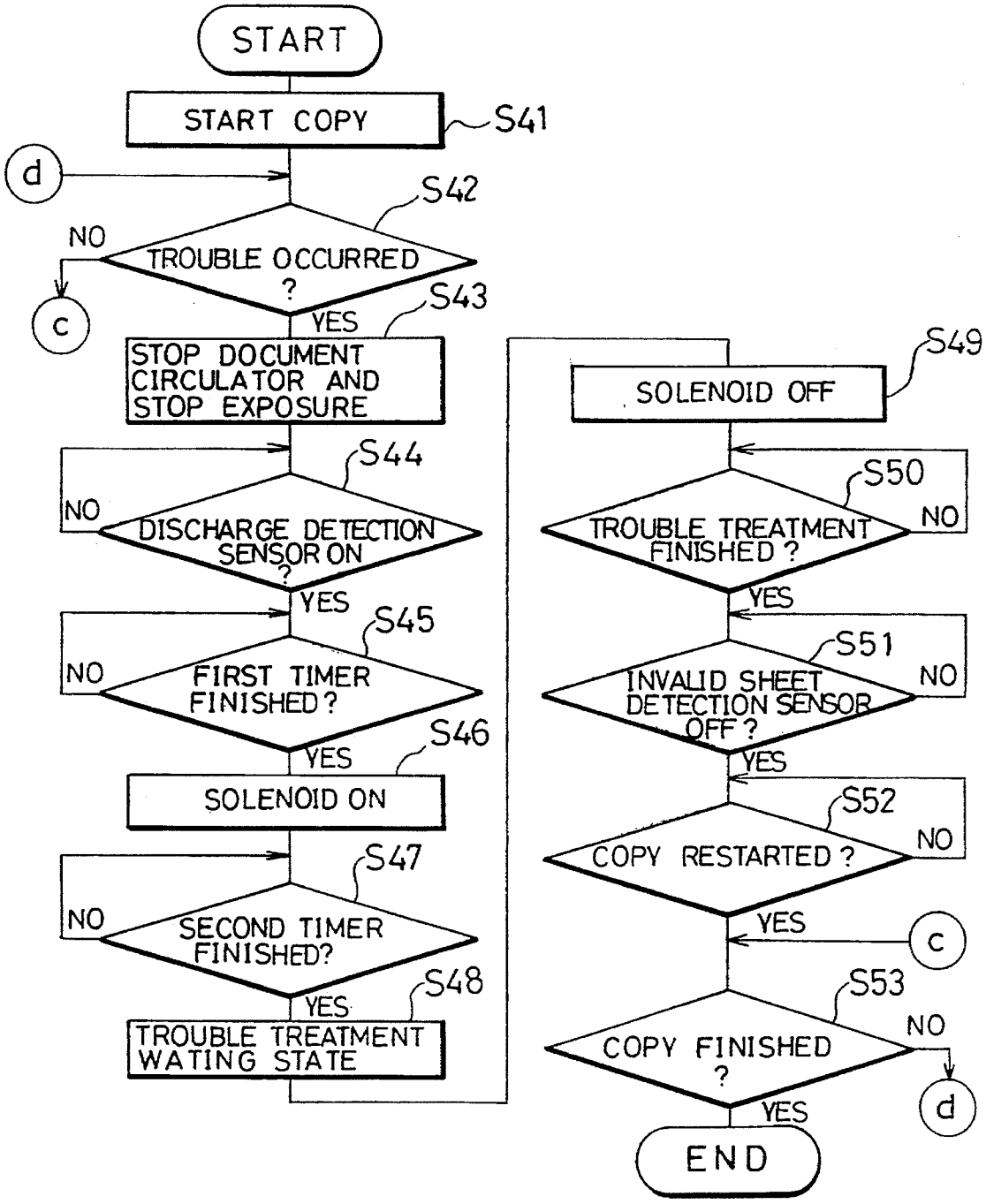

Next, the following description will discuss another embodiment of the present invention referring to FIGS. 8 and 9. Here, those members of the present embodiment that have the same arrangement and function, and that are mentioned in the aforementioned embodiment are indicated by the same reference numerals and description thereof is omitted.

A sheet postprocessing apparatus of the present embodiment is installed in the same type of a copy machine in the embodiment 1. Furthermore, the arrangement of the sheet postprocessing apparatus is also substantially similar to that of the embodiment 1, but as shown in FIG. 8, there exists a different point that a nonslip member (invalid sheet anti-falling means) 74 for preventing the invalid sheets S' stored on the sheet pressing arm 58 from falling down is provided on the upper surface on the forward end of the sheet pressing arm 58.

In the case where the nonslip member 74 is provided in order to prevent the invalid sheets S' from falling down on the sheet receiver 46 when the departing operation of the sheet pressing arm 58 is carried out, even if the invalid sheets S' are detected by the invalid sheet detection sensor 73, the departing operation of the sheet pressing arm 58 can be carried out.

The description will be given of an operation of the sheet postprocessing apparatus of the present embodiment when a trouble occurs. Here, the processes from the operation for starting the copy operation (S41) to the operation for being in the trouble treatment waiting state of the copy machine main body (S48) is same as that from S21 to S28 in the flow chart of FIG. 7 referred in the embodiment 1, so the description is omitted.

When the invalid sheets S' are discharged from the copy machine main body and a judgement is made that the invalid sheets S' are stored on the sheet pressing arm 58 (S47) by the completion of the second timer operation, the copy machine main body is in the trouble treatment waiting state (S48). Then the solenoid 57 is turned off (S49), and the sheet pressing arm 58 departs from the sheet receiver 46 so as to push up the invalid sheets S' stored thereon. At this time, the invalid sheets S' may fall down from the sheet pressing arm 58 depending upon the storing state of the invalid sheets S, but the nonslip member 74 prevents the invalid sheets S' from falling down, thereby making it possible to clearly separate the valid sheets S stored under the sheet pressing arm 58 from the invalid sheets S' stored on the sheet pressing arm 58.

Thereafter, when a judgement is made that treatment for releasing a trouble is completed (S50), successively a judgement is made as to whether or not the invalid sheet detection sensor 73 is turned off (S51) so that a judgement is made as to whether or not the invalid sheets S' are removed from the sheet detection sensor 51. Here, in the case when the invalid sheets S' are removed, the invalid sheets S' moves upward, so they further departs from the valid sheets S in accordance with the departing operation of the sheet pressing arm 58. As a result, an operator can remove only the invalid sheets S' without a mistake.

When the removal of the invalid sheets S' is detected, the copy operation restarts (S52). Then, when the document which has not been copied due to the trouble is finished to be copied, a judgement is made that the copy operation is completed (S53), and the copy operation ends.

As mentioned above, the invalid sheets S' do not fall down from the sheet pressing arm 58 by providing the nonslip member 74 on the sheet pressing arm 58 even when the departing operation of the sheet pressing arm 58 is carried out before the removal of the invalid sheets S', and the invalid sheets S' are pushed upward, thereby making it easy to carry out the removal.

[EMBODIMENT 3]

Figure 10:
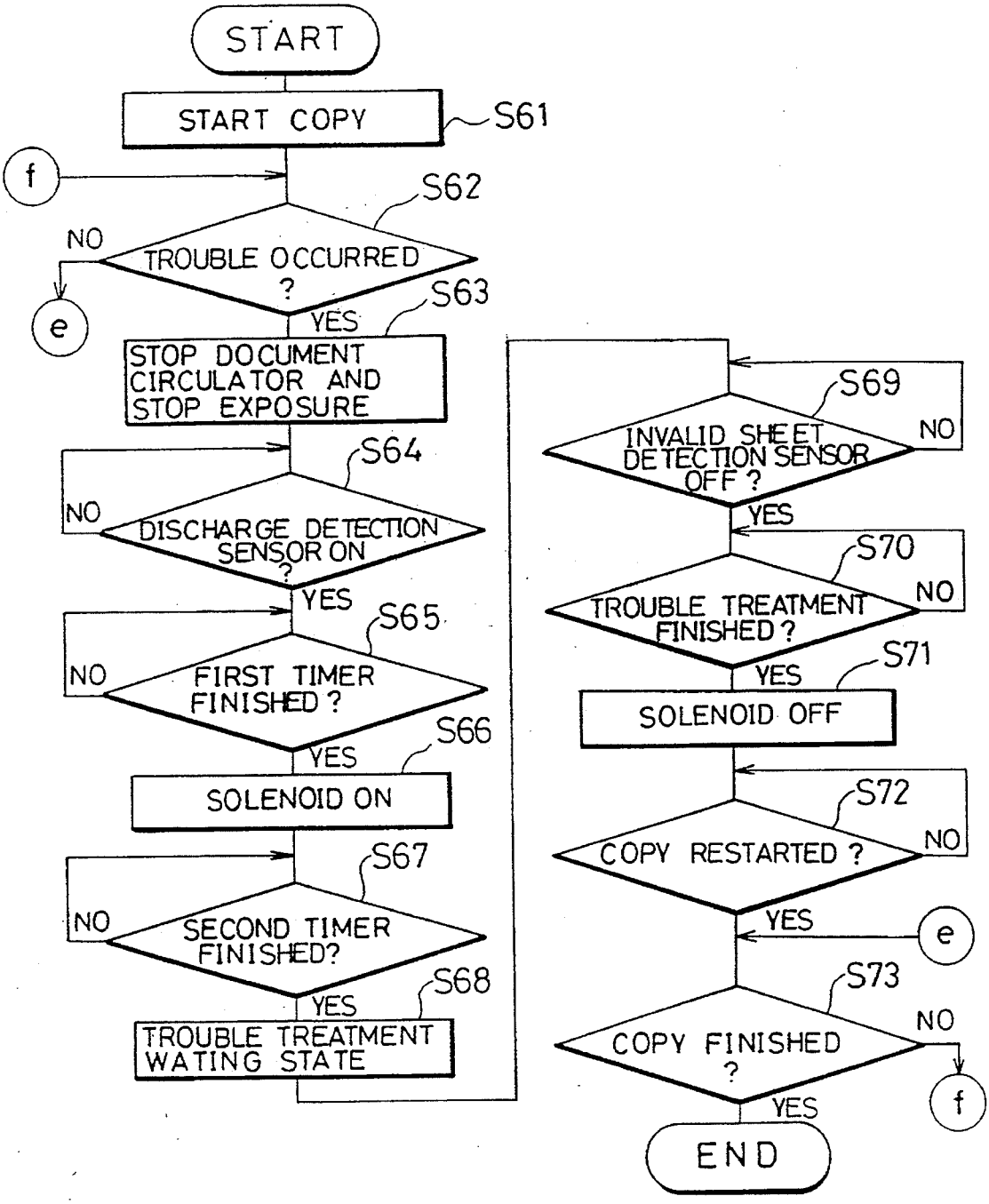
FIG. 10 is a flow chart which shows the procedure of processes in a sheet postprocessing apparatus when a trouble occurs in an image forming apparatus according to still another embodiment of the present invention.

Next, the following description will discuss still another embodiment of the present invention referring to FIG. 10. Here, those members of the present embodiment that have the same arrangement and function, and that are mentioned in the aforementioned embodiment are indicated by the same reference numerals and description thereof is omitted. The sheet postprocessing apparatus of the present embodiment is installed on the same type of a copy machine as that of embodiment 1. Moreover, the structure of the sheet postprocessing apparatus is also substantially similar to the sheet postprocessing apparatus of the embodiment 1, but only a timing is different for carrying out departing operation of the sheet pressing arm 58 at the time a trouble occurs.

The description will be given of the operation of the sheet postprocessing apparatus according to the present embodiment when the trouble occurs referring to a flow chart of FIG. 10. Here, processes from the operation that copying is started (S61) to the operation that the copy machine main body 11 is in the trouble treatment waiting state (S68) are same as those from S21 to S28 in the flow chart of FIG. 7 referred in the embodiment 1, so the description thereof is omitted.

When the copy machine main body 11 is in the trouble treatment waiting state (S68), successively a judgement is made as to whether or not the invalid sheet detection sensor 73 is turned off (S69) so that a judgement is made as to whether or not the invalid sheets S' are removed from the sheet pressing arm 58. When the invalid sheets S' are removed and a judgement is made that the trouble treatment is completed (S70), the solenoid 57 is turned off (S71), and the sheet pressing arm 58 departs from the sheet receiver 46. In other words, the departing operation of the sheet pressing arm 58 is carried out by receiving a trouble release signal from the copy machine main body 11. Thereafter, the copy operation restarts (S72), and when the document which has not been copied due to the trouble is finished to be copied, a judgement is made that the copy operation is completed (S73) so that the copy operation ends.

As mentioned above in the present embodiment, after the sheet postprocessing apparatus receives the trouble treatment signal from the copy machine main body 11, the departing operation of the sheet pressing arm 58 is carried out before the copy operation restarts. Therefore, since not only the removal of the invalid sheets S' but also departing operation of the sheet pressing arm 58 have been completed by the time the copy operation restarts, the sheets S transported by restarting the copy operation are stored in regular order on the sheet receiver 46 after the valid sheets S stored thereon before the occurrence of the trouble.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A sheet postprocessing apparatus provided with a sheet receiver for receiving sheets fed from an image forming apparatus, detection means for detecting whether or not the sheets are on the sheet receiver, and sheet postprocessing means for carrying out a predetermined sheet postprocessing on the sheets stored on the sheet receiver when it is detected by said detection means that sheets exist, comprising:

pressing means for pressing the sheets on the sheet receiver towards said detection means; and control means for controlling said pressing means so that the pressing operation is carried out when said detection means detects that the sheets do not exist on the sheet receiver, and for making said detection means detect again as to whether or not the sheets exist on the sheet receiver after the pressing operation.

2. The sheet postprocessing apparatus as defined in claim 1, wherein:

said detection means is installed so as to be capable of contacting with the sheets on the upper surface of the sheet receiver, and said control means controls said pressing means so that the pressing operation is carried out a predetermined number of times when the detection result by said detection means is changed from non-existence of sheets to existence of sheets by the pressing operation of said pressing means.

3. A sheet postprocessing apparatus having a sheet receiver for receiving sheets transported from an image forming apparatus, said device being installed in the image forming apparatus capable of successively forming images, comprising:

pressing means for pressing the sheets stored on the sheet receiver towards the sheet receiver; and control means for controlling said pressing means so that the pressing operation is carried out at the time all valid sheets are stored on the sheet receiver in the case where a trouble occurs in the image forming apparatus which is successively carrying out the image forming operation, and valid sheets where the image has been normally formed before the occurrence of the trouble and invalid sheets where the image has not been normally formed after the occurrence of the trouble are fed.

4. The sheet postprocessing apparatus as defined in claim 3 wherein said control means controls said pressing means so that the pressing operation is released when transportation of the invalid sheets to the sheet receiver is completed.

5. The sheet postprocessing apparatus as defined in claim 4, further comprising invalid sheet fall-prevention means for preventing the invalid sheets stored on said pressing means from falling down.

6. The sheet postprocessing apparatus as defined in claim 5, wherein said invalid sheet fall- prevention means includes a nonslip member for preventing the invalid sheets from falling down, said nonslip member being installed on a portion on the upper part of said pressing means where said pressing means contacts with said invalid sheets.

7. The sheet postprocessing apparatus as defined in claim 3, wherein said control means controls said pressing means so that the pressing operation is released when a trouble release signal is received from the image forming apparatus.

8. the sheet postprocessing apparatus as defined in claim 3, wherein said control means controls said pressing means so that the pressing operation is released at a predetermined timing after the invalid sheets are removed and the image forming operation restarts.

9. The sheet postprocessing apparatus as defined in claim 3, further comprising:

invalid sheet detection means for detecting as to whether or not the invalid sheets stored on said pressing means exist, wherein said control means allows said pressing means to release the pressing operation when said invalid sheet detection means detects that the invalid sheets are removed from said pressing means.

* * * * *